US005368020A

United States Patent [19]

Beux

[11] Patent Number: 5,368,020

[45] Date of Patent: Nov. 29, 1994

[54] AUTOMATIC BREATHING APPARATUS FOR UNDERWATER IMMERSION AT MEDIUM AND GREAT DEPTH

[76] Inventor: Claudio Beux, c/o Gilberto Alessandrini 374/C Via della Magliana, I-00148 Roma RM, Italy

[21] Appl. No.: 937,033

[22] Filed: Aug. 31, 1992

[51] Int. Cl.[5] ..... A62B 9/02

[52] U.S. Cl. ..... 128/204.29; 128/204.22; 128/204.26; 128/205.11; 128/205.17; 128/205.24; 128/205.28

[58] Field of Search ..... 128/204.18, 204.21, 128/204.22, 204.26, 204.29, 205.11, 205.12, 205.13, 205.17, 205.22, 205.24, 205.28

[56] References Cited

U.S. PATENT DOCUMENTS

| | | | |
|---|---|---|---|
| 3,068,864 | 12/1962 | Tietze | 128/203.14 |
| 3,827,432 | 8/1974 | Lundgren | 128/204.29 |
| 4,450,837 | 5/1984 | Ream | 128/201.27 |
| 4,648,397 | 3/1987 | Beale | 128/205.11 |
| 4,823,788 | 4/1989 | Smith et al. | 128/205.24 |
| 4,964,404 | 10/1990 | Stone | 128/204.22 |
| 5,097,860 | 3/1992 | Ferguson et al. | 137/78.1 |

FOREIGN PATENT DOCUMENTS 2110018 12/1962 France .

*Primary Examiner*—Edgar S. Burr
*Assistant Examiner*—Eric P. Raciti
*Attorney, Agent, or Firm*—Browdy and Neimark

[57] ABSTRACT

The disadvantages of operation "rigidity" found in automatic breathing apparatus according to the prior art are overcome by means of a regulator group made in a number of versions and capable of adjusting, moment by moment, according to the surrounding pressure or depth, the percentage of breathing gases forming the final breathing mixture, which can be made up of various percentages of oxygen and air, or oxygen and helium, or air and a Heliox mixture, or air, oxygen and helium.

Mixture of the various basic gases forming the final breathing mixture is controlled by means of modular adjustment and/or control elements which can be combined together in various manners to give the above mentioned operative characteristics.

2 Claims, 7 Drawing Sheets

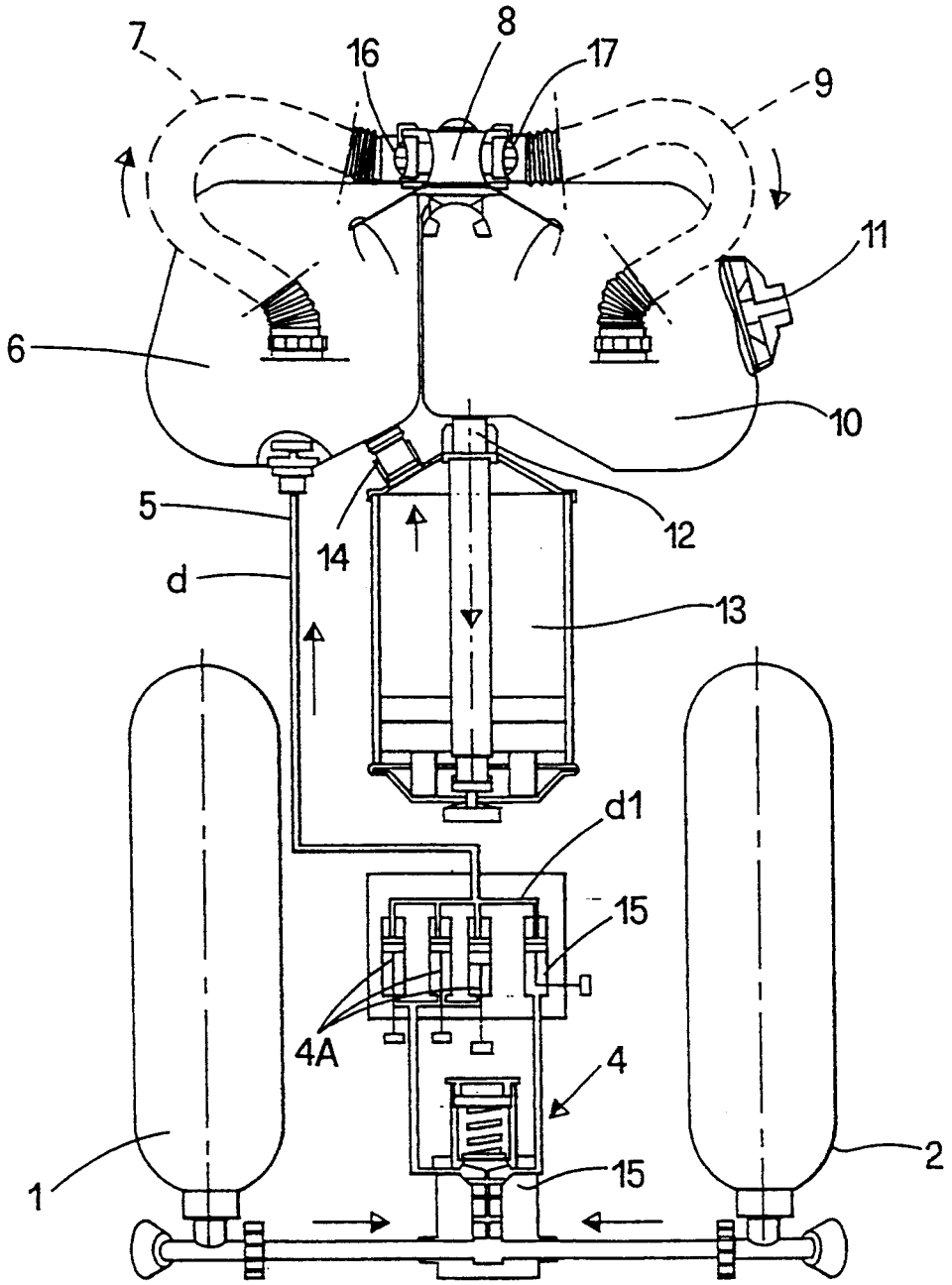
FIG.1 *(PRIOR ART)*

AUTOMATIC BREATHING APPARATUS FOR UNDERWATER IMMERSION AT MEDIUM AND GREAT DEPTH

BACKGROUND OF THE INVENTION

1. Field of the Invention

The present invention relates to an improvement in automatic breathing apparatus for underwater immersion of the semi-closed circuit type, said improvement consisting in mixing breathing gases in a controlled and optimal proportion according to depth, over a range which can extend from close to the surface of the water to relatively great depths, of up to around 150 meters.

2. Description of the Prior Art

The known automatic breathing apparatus of this kind work using a semi-closed circuit, with partial replacement of the breathing gas (He, $O_2$) which is preprepared in varying proportions according to the depth range chosen and with re-cycling of the breathed gas through a conventional filter for elimination of carbon dioxide of the soda lime type. A typical automatic breathing apparatus for use at great depth according to the prior art, using a semi-closed circuit, is schematically illustrated in FIG. 1. As can be seen, the automatic breathing apparatus comprises a pair of gas cylinders 1, 2, for a mixture of helium and oxygen known in the field as a "Heliox" mixture. The cylinders 1 and 2 are connected to a pressure reducing valve 4 which is in turn connected, downstream, to the selector group 4A containing, at its outlet end, the "nozzles" or "holes" which condition the flow rate of the breathing gas according to the diameter of the hole itself. It should be remembered that, in this case, the pressure of the reducing valve 4 remains unchanged at all depths, and for this reason it is necessary to operate using the manual switch which changes "nozzle" or "hole", thus varying the flow rate of the gas.

The breathing gas, which passes through the chosen "hole" or "nozzle", enters the tube 5 leading to an aspiration plenum chamber or bag 6, from which a tube 7 leads to a mouthpiece 8. The mouthpiece 8 is also connected by means of a tube 9 to an expiration or discharge bag 10, which is in communication on one side with an overpressure valve 11, and on the other side with a tube 12 leading to a soda lime type carbon dioxide absorber indicated with 13. The absorber 13 communicates by way of 14 with the inspiration bag 6. The direction of flow of the gases is conditioned by no-return valves 16 and 17 and is indicated by the arrows. Finally, a by-pass device 15 is usually provided, actuated manually so as to compensate for the collapse of the "bags" 6, 10, due to increase of environmental pressure (the head of water above).

SUMMARY OF THE INVENTION

Object of the present invention is to provide an arrangement of units for adjustment and mixing of breathing gas capable of giving greater flexibility of automatic adaptation or adjustment to environmental working conditions, unlike the known structures, which require a prior determination of the percentages of helium and oxygen in the mixture known as Heliox, according to the range of depths at which work is to be performed.

According to the present invention, the disadvantages of working "rigidity" seen in automatic breathing apparatus according to the prior art can be overcome by means of an adjustment group made in a number of versions and capable of adjusting, moment by moment, according to the environmental pressure or depth, the percentages of breathing gases forming the final mixture, which can be formed of various percentages of air and oxygen, or oxygen and helium, or air and Heliox mixture, or air, oxygen and helium.

Also according to the present invention, mixing of the various basic gases to form the final breathing mixture is controlled by means of modular adjustment and/or control elements which can be combined together in various ways to obtain the above mentioned working characteristics.

BRIEF DESCRIPTION OF THE DRAWINGS

The present invention will now be described with reference to its presently preferred embodiments, given as a non-limiting illustration, on the basis of the figures in the enclosed drawings, in which:

FIG. 1 shows the architecture of a semi-closed cycle automatic breathing apparatus according to the prior art;

DESCRIPTION OF THE PREFERRED EMBODIMENT

In the following description, the flow regulators illustrated in FIGS. 6, 7, 8 and 9 will, to simplify description, be referred to as "type A", "type B", "type C" and "type D".

Figure 2:
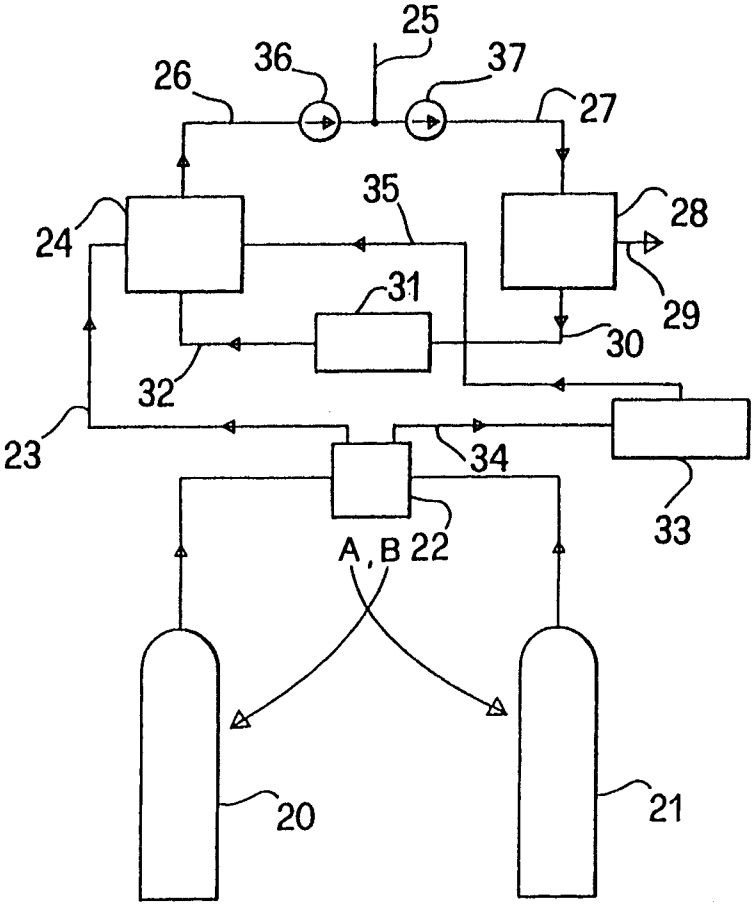
FIG. 2 shows the architecture of a first form of automatic breathing apparatus according to the invention.

With reference to FIG. 2, a first embodiment of an automatic breathing device of the semi-closed type, suitable for use at depths of approximately 50 meters, of the type using air and oxygen, comprises respectively an air cylinder indicated in 20, an oxygen cylinder indicated in 21, which feed into a regulator group indicated in 22, in which a type A regulator and a type B regulator are arranged, respectively. A tube 23 leads from the regulator group 22 to an inspiration plenum chamber or bag 24 of the type previously described, reaching a mouthpiece 25 by means of a tube 26. The exhalation gases from the mouthpiece 25, by means of a tube 27, reach the discharge bag 28, which is provided with an overpressure discharge valve outlined in 29, and then by means of a tube 30 reach a soda lime filter 31 which is reconnected to the inspiration bag 24 by means of a tube 32. No-return valves represented in 36, 37 allow the inspiration/expiration gases to flow in the direction indicated by the arrows. A by-pass device 33 allows the regulator group 22 to be connected directly with the inspiration bag 24 by way of tubes 34, 35, by-passing the nozzles at the exits of the regulators. For greater clarity, the direction of passage of the gases is indicated by the arrows. The type A and type B regulators will be described below.

Figure 3:
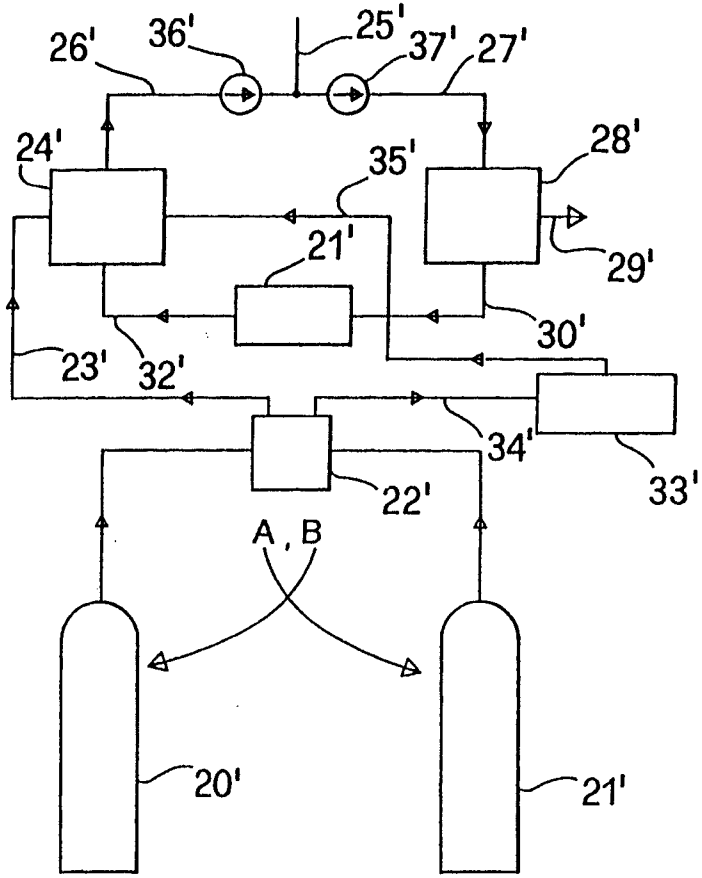
FIG. 3 shows the architecture of a second form of automatic breathing apparatus according to the invention.

With reference to FIG. 3, another type of architecture is described for an automatic breathing device of the semi-closed type, of the kind using a helium cylinder and an oxygen cylinder. A breathing device of this kind is suitable for use at depths of up to approximately 150 meters. It works starting at surface level with a suitable amount of pure oxygen, and as descent progresses a mixture of correct proportions of helium and oxygen is formed until reaching the pre-established depth limit. In this architecture also there is a helium cylinder 20', an oxygen cylinder 21', a regulator group 22' comprising regulators of type A and type B, which differ from those described with reference to FIG. 2 in that they are differently calibrated, an inspiration bag 24' connected by means of a tube 23' to the regulator group 22', a tube 26' leading to a mouthpiece 25', a return tube 27' for the exhaled gases, leading to the discharge bag 28', which is provided with an overpressure discharge valve 29', said bag 28' being connected by means of a tube 30' to the soda lime filter 21'' which is reconnected by means of 32' to the inspiration bag. No-return valves diagrammatically shown in 36', 37' allow the inspiration/exhalation gases to flow in the direction indicated by the arrows. In this case also a by-pass device 33' is provided to exclude the nozzles situated at the outlet of the regulators, and said device is connected by means of tubes 34', 35' to the inspiration bag.

Figure 4:
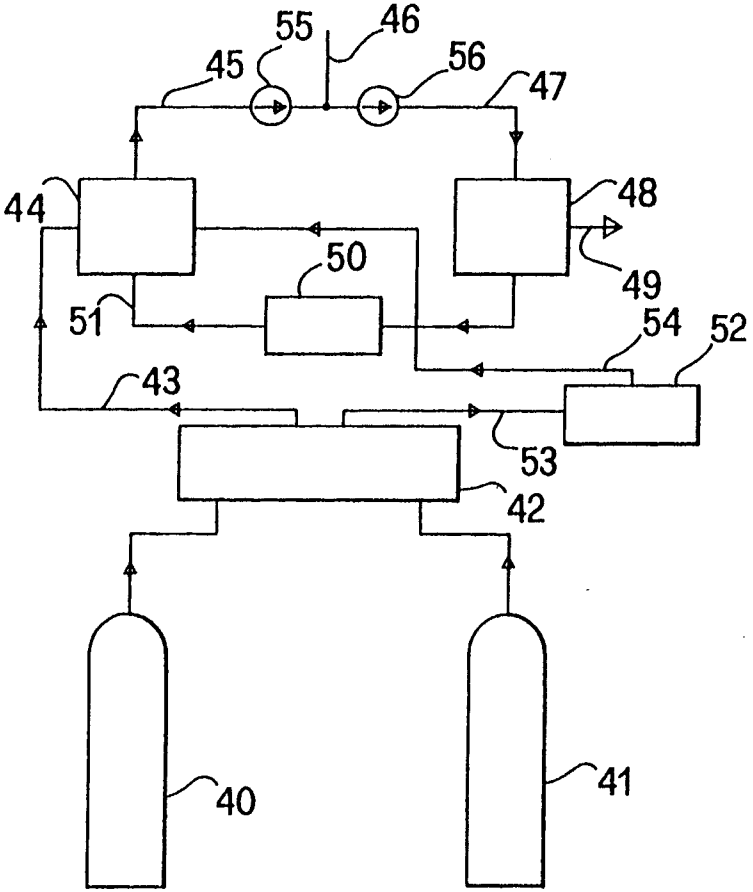
FIG. 4 shows the architecture of a third form of automatic breathing apparatus according to the invention.

In FIG. 4 a further embodiment of the type of automatic breathing device in question is shown, which works using a mixture of air and Heliox (a mixture formed as previously stated by suitable proportions of helium and oxygen) so as to breath air on the surface or at low depths and, on descending, to mix the air with Heliox in an optimum proportion for each depth, said proportions varying according to the changes in environmental pressure, until reaching the maximum depth provided for, which corresponds to approximately 150 meters. This is done to save helium, because by mixing the air mixture and the Heliox mixture there is a saving of the latter. In this case, there is an air cylinder 40, an Heliox cylinder 41, connected respectively to a group of four pressure reducers of types A, B, C and D indicated as a whole in 42, from one side of which a tube 43 runs out to an inspiration bag 44, which is connected to a mouthpiece 46 by means of a tube 45. The mouthpiece 46 is in communication through a tube 47 with a discharge bag 48 provided with an overpressure valve 49, and said bag 48 is also connected in a substantially conventional manner by a tube 49A to a soda lime filter 50, which is in turn reconnected by means of a tube 51 to the inspiration bag 44. No-return valves schematically shown in 55, 56 allow the inspiration/exhalation gases to flow as indicated by the arrows. In this case also a by-pass 52 excluding the nozzles on the outlet side of the regulators is connected to the .reducer group 42 by means of a tube 53, and to the inspiration bag 44 by means of a tube 54.

Figure 5:
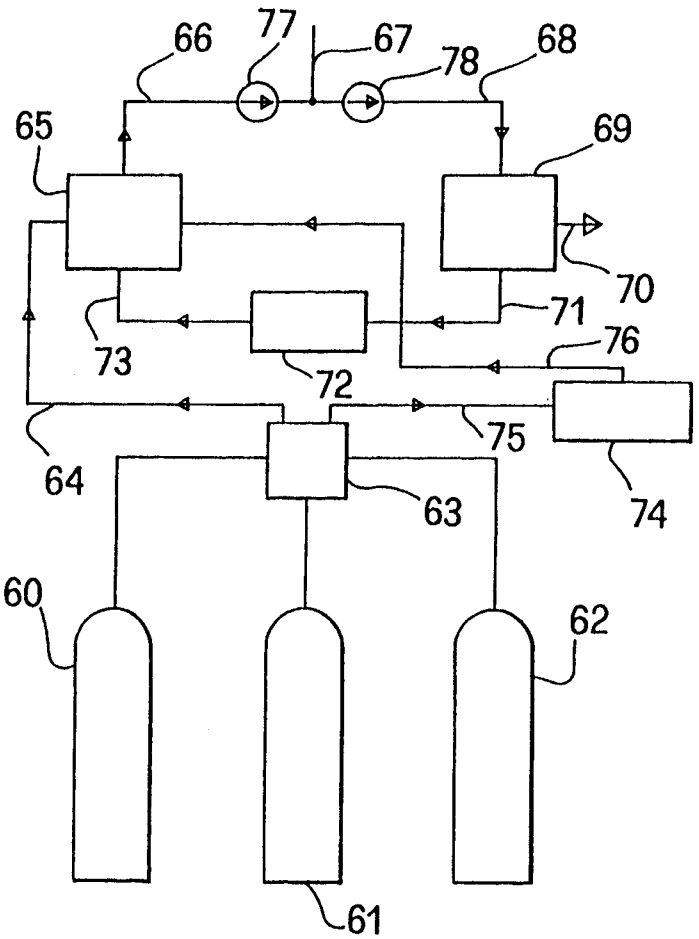
FIG. 5 shows the architecture of a fourth form of automatic breathing apparatus according to the invention.

In FIG. 5, a further embodiment is illustrated, in which are provided an air cylinder 60, an oxygen cylinder 61, and a helium cylinder 62. These cylinders are connected to an adjustment group 63, comprising regulators of types A, B, a modified form of the regulator of type B, and a regulator of type C. As previously indicated, a tube 64 leaves the regulator group 63, said tube 64 leading to the inspiration bag 65, which in turn leads to .the mouthpiece 67 by way of a tube 66. From the mouthpiece 67 the breathing gas, which is forced by the no-return valves to follow the circuit indicated by the arrows, after passing through the tube 68, reaches the discharge bag 69 which is provided with an overpressure valve 70. The bag 69 is in communication by means of the tube 71 with the soda lime filter 72, which is in turn reconnected to the inspiration bag 65 by means of 73. A by-pass device 74, which excludes the nozzles situated on the outlet side of the regulators, connects up the regulator group 63 by means of a tube 75, and is connected to the inspiration bag by means of a tube 76. No-return valves schematically illustrated in 77, 78 allow the inspiration/exhalation gases to flow as indicated by the arrows.

In this case we are dealing with an automatic breathing apparatus of the semi-closed circuit type, for general use, which has the advantage that it is not necessary to prepare the Heliox mixture with prefixed proportions of helium and oxygen in advance. Use of this type of automatic breathing apparatus can also reach depths of up to approximately 150 meters.

Before giving a more detailed description of the reducers of types A. B. C and D, it is considered opportune to give a brief description of the functions of each.

Type A

As the environmental pressure (Pa) increases, that is to say as the depth increases, it causes the calibration pressure to decrease and, consequently, decreases the flow of gas through the "nozzle" situated downstream.

Type B

As the environmental pressure (Pa) increases, that is to say as the depth increases, it causes the calibration pressure to increase and, consequently, increases the flow of gas through the "nozzle" situated downstream.

Type C

This works alongside the regulator of type A. This type C regulator serves to compensate the progressive decrease in calibration, and therefore in flow, which takes place in the type A reducer when the pressure in the air cylinder falls to a level lower than the environmental calibration of the reducer itself.

The type C reducer which, unlike the type A one, progressively increases its calibration upon the progressive decrease of pressure in the cylinder, consequently increases the flow which, when summed with the flow of the type A regulator, which decreases constantly, maintains constant the optimum value.

Type D

This is a transfer regulator. It works like the type C regulator, but is controlled by the helium-oxygen (Heliox) mixture, and serves to transfer air into the cylinder containing the oxygen and helium mixture should it become necessary to use open circuit breathing (an emergency breathing system provided for in this kind of apparatus), which would cause excessive consumption of the Heliox mixture, giving a consequent reduction of autonomy.

Figures 6, 7, 8, 9:
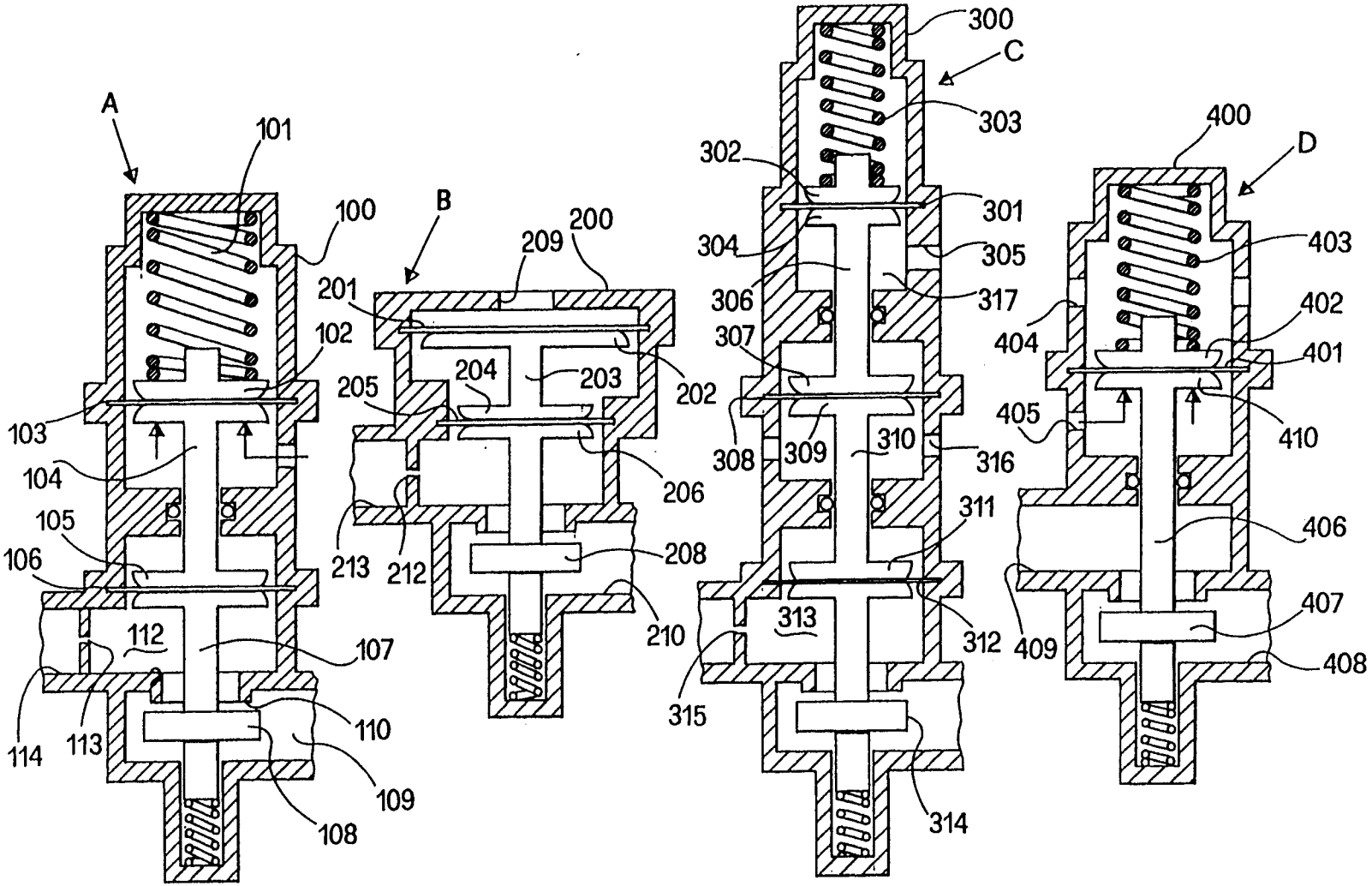
FIG. 6 shows a cross-section view of a first flow regulator according to the invention.
FIG. 7 shows a cross-section view of a second flow regulator according to the invention.
FIG. 8 shows a cross-section view of a third flow regulator according to the invention.
FIG. 9 shows a cross-section view of a fourth flow regulator according to the invention.

With reference now to FIG. 6, the structure and function of the type A pressure reducer will now be described. This type of regulator comprises a body 100, which houses a spring 101 which can be calibrated (using means not shown in the figure) during its manufacturing stage according to the type of breathing apparatus for which it is to be used, said body activating a diaphragm 103 by means of a disk 102. The disk 102 is integral with a mechanical connection element 104, and with a further disk 105, which cooperates with a diaphragm 106 which, by means of a mechanical connection element 107, cooperates with a plug 108 which regulates the flow of gas and therefore regulates the pressure of the gas (said gas coming from tube 109 in communication with the cylinder) in the chamber 112. According to the contrasting play exercised on the spring 101 by the environmental pressure Pa, that is to say the pressure of the water at the immersion depth which is sensed by the regulator through a bore 111 in communication with the environment and which acts on the lower face of the diaphragm 103. The chamber 112 containing the gas at a regulated pressure communicates by means of a nozzle 113 with a tube 114 leading to the inspiration bag. As can be seen, the environmental pressure, that is to say the water pressure, in this type of construction, contrasts the thrust of the spring 101, and consequently decreases the flow of gas leaving the nozzle 113 and entering the tube 114.

With reference to FIG. 7, the type B reducer will now be described.

As can be seen from FIG. 7, this reducer comprises a body 200, a diaphragm 201 cooperating with a disk 202 which, by means of a mechanical connection member 203 cooperates with a further disk 204 associated with a diaphragm 205 which, by means of the disk 206 and the mechanical connection element 207, cooperates with a plug 208. Unlike the type A regulator, in this case stress is placed on the diaphragm 201 by environmental pressure, that is to say by water pressure, which acts directly on the surface of the diaphragm 201 through the bore 209, providing the calibration thrust which varies according to environmental pressure. Given that the surface of the diaphragm 102 is greater than the surface of the diaphragm 205, the calibration pressure inside the chamber 211 relates to the environmental pressure and to the difference between the two surfaces 201 and 205. The greater the Pa (environmental pressure), the greater the calibration pressure, and likewise the greater the difference between the surfaces, the greater the calibration pressure. Through the communication 210 the gas enters the chamber 211 and, when it has reached a pressure sufficient to balance the Pa thrust working on the surface of the diaphragm 201, allows the plug 208 to close, providing the relative calibration of the chamber 211, as mentioned above. Through the flow restriction nozzle 212 the gas enters the tube 213 which sends it to the inspiration bag.

Since this regulator has a higher calibration when the Pa is higher, consequently, the flow will be greater as depth increases. In the preferred embodiment, this regulator (type B) is used to regulate the flow of the air mixture, as will be more clearly described herebelow.

With reference now to FIG. 8, the pressure reducer of type C will be described.

As can be seen from this figure, this reducer comprises a body 300, a diaphragm 301 cooperating with a disk 302 actuated by a regulation spring 303. The bottom of the diaphragm 301 is exposed to a chamber 317 which, through a bore 305, is in communication with the pressure Pm of the air cylinder and is subject to direct pressure therefrom, contrasting the action of the spring 303, which only intervenes when the pressure in the cylinder, and therefore in the chamber 317, descends to a level below that of the calibration thrust of the spring 303. The diaphragm 301 cooperates, by means of the disk 304 and the connection element 306, with another disk 307 associated to a diaphragm 308, which is exposed to environmental pressure Pa (head of water) through the bore 316. The disk 309 is connected, by means of the connection element 310, to another disk 311 which cooperates with a diaphragm 312 which is exposed to the pressure in the chamber 313 regulated by the plug 314. The chamber 313 is connected to the flow restriction nozzle 315 which leads toward the inspiration bag.

This type of regulator, as previously indicated, is made to operate in combination with the pressure reducer of type A, and serves to compensate the normal drop in pressure Pm which results in the cylinder during use of the automatic breathing apparatus.

The innovative technical characteristic of this type of reducer lies in the addition of diaphragms 301 and 307 which, being exposed to the pressures Pa (head of water) and Pm of the cylinder, respectively, regulate the intervention of the reducer.

This reducer (type C) serves, as will be seen, to recover the residual air contained in the cylinder when the pressure in said cylinder drops to a level below that of the environmental calibration of the type A reducer.

With reference now to FIG. 9, the type D, or transfer regulator will now be described.

As can be seen from this figure, this reducer comprises a body 400, a diaphragm 401 cooperating with a disk 402 actuated by a regulation spring 403. The side of the diaphragm 401 facing the spring 403 is subject, thanks to the bore 404, to environmental pressure Pa (head of water). Below, the diaphragm cooperating with the disk 410 is subject to the pressure Pm of the Heliox, said pressure being applied through the bore 405. The disk 410, by means of the connection element 405, cooperates with the plug 407, which permits transfer of air from the tube 408 towards the tube 409 leading to the cylinder containing the Heliox mixture.

This takes place when the pressure in the cylinder containing Heliox drops to a level below that of the environmental calibration of the spring 403. It therefore overcomes the counterthrust of the pressure of the Heliox on the lower surface of the diaphragm 401, permitting the plug 407 to open and transfer air.

This pressure regulator of type D has the job of transferring air into the cylinder containing the Heliox mixture should it be necessary for the diver to breath using an open circuit, for example in the case of emergency surfacing.

Figure 10:
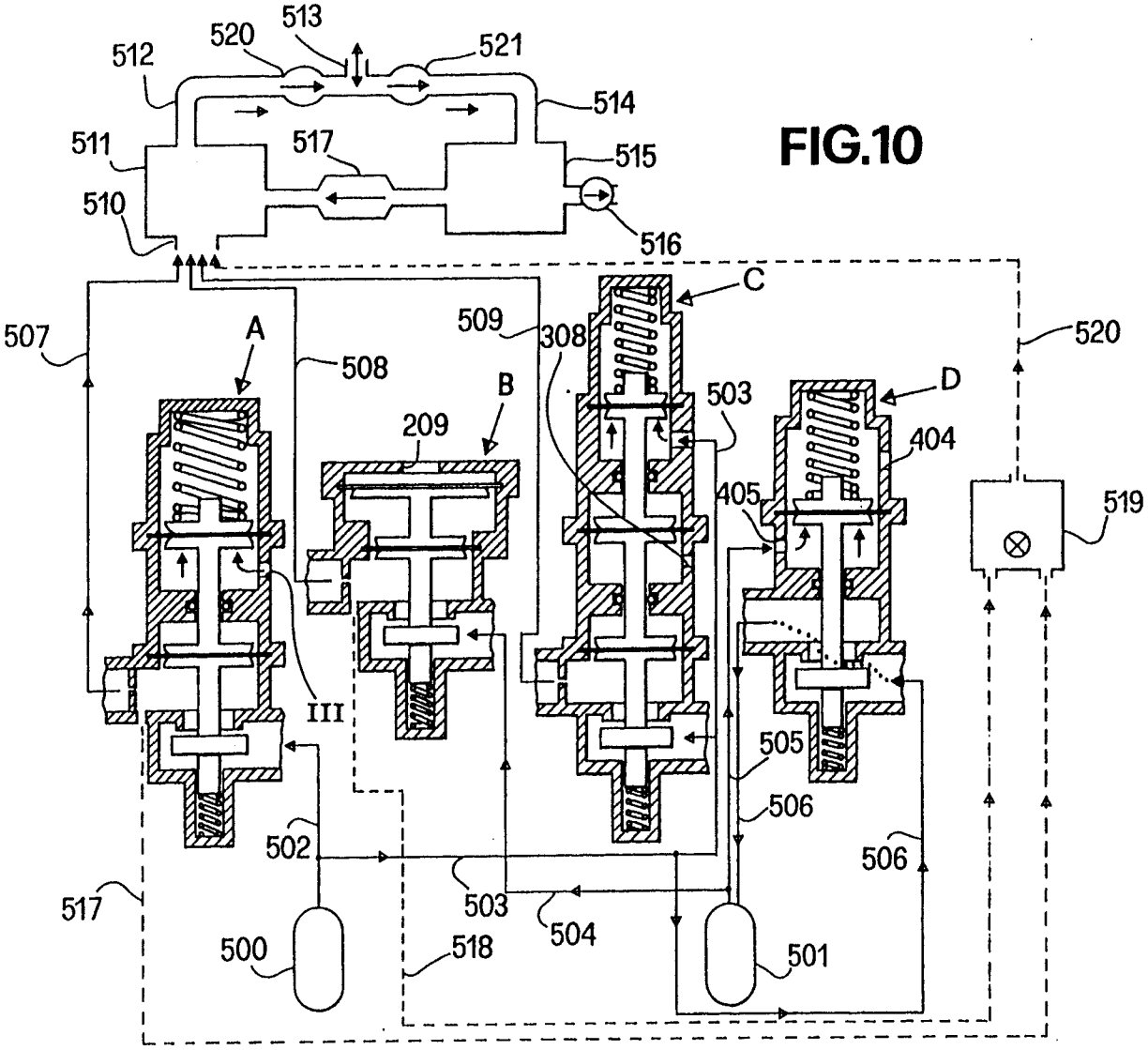
FIG. 10 shows in detail the structure of the regulator group for an automatic breathing device according to the invention for general use.
Figure 11:
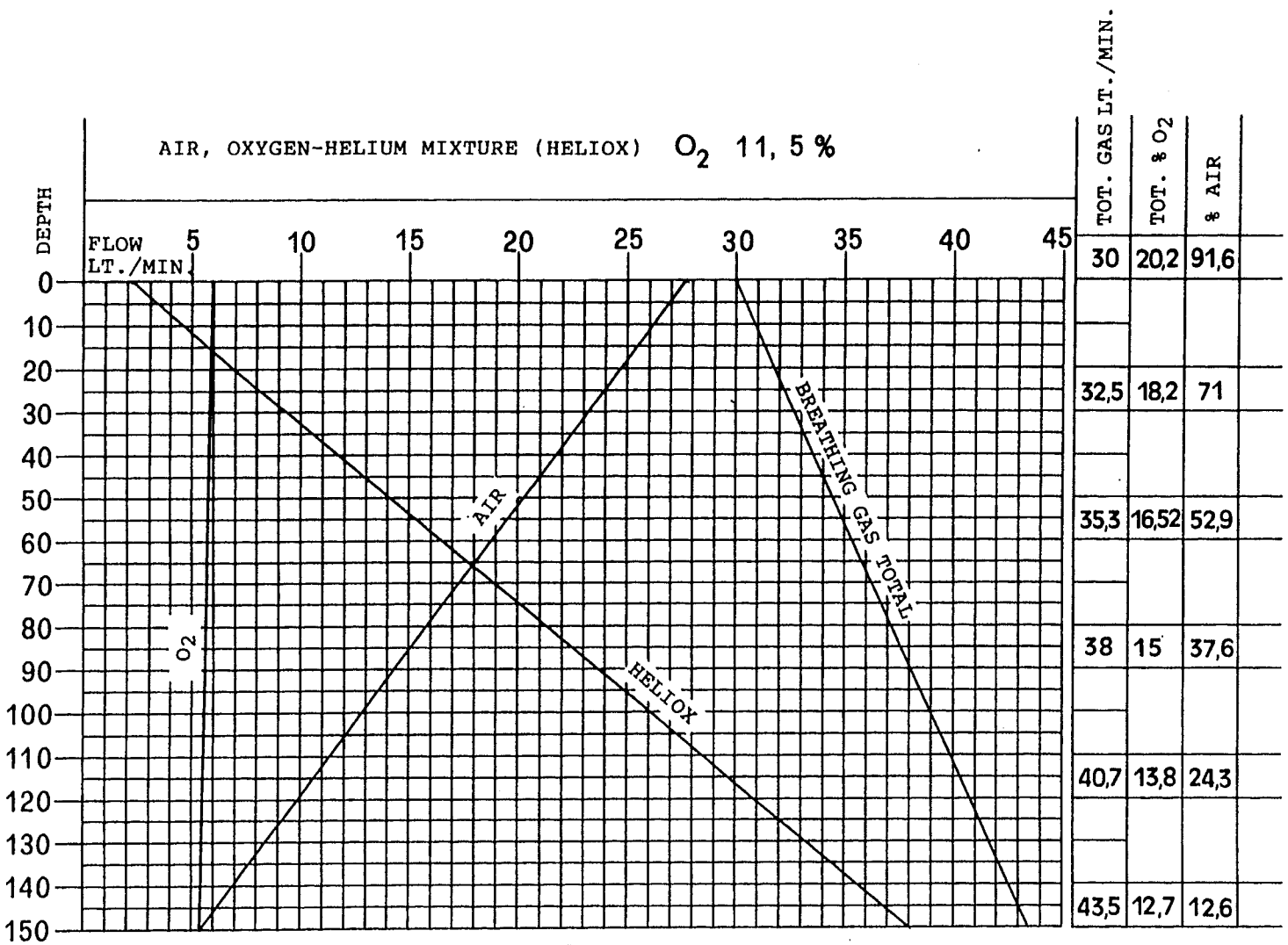
FIG. 11 shows a diagram representing the state of flow of breathing gases according to the depth of immersion for an automatic breathing device as illustrated in FIG. 10.

With reference now to FIGS. 10 and 11, the preferred embodiment of the automatic breathing apparatus according to the present invention will be described.

As can be seen from FIG. 10, the automatic breathing apparatus comprises a group of regulators A, B, C, D, (previously described in detail in the discussion of FIGS. 6, 7, 8 and 9).

The automatic breathing apparatus is fed by a cylinder 500 containing compressed air and by a cylinder 501 containing a compressed mixture of helium and oxygen (Heliox). Through tubes 502, 503 and 503A, the compressed air reaches regulator A and regulator C. Through tube 504, the helium-oxygen mixture reaches regulator B. Through tube 505 the Heliox mixture reaches the entrance 405 to regulator D (FIG. 9) and regulates the intervention thereof.

The cylinder 500 (air) and the cylinder 501 (Heliox) are also interconnected through tube 506 by means of the transfer regulator D.

The outlets from regulators A, B, C, respectively through tubes 507, 508, 509 downstream of the nozzles, are connected to the input side 510 of the inspiration bag 511, which communicates by means of tube 512 with the mouthpiece 513, provided on its input and outlet sides with no-return valves 520, 521.

The mouthpiece 513 communicates, by means of the tube 514, with the exhalation bag 515, which is provided with an overpressure valve 516. The exhalation bag 515 and inspiration bag 511 are in communication with the soda lime filter 517.

The pressure chambers of the regulators A and B (upstream of their respective distribution nozzles) are connected by means of tubes 517, 518 with a tap/by-pass of a known kind, indicated with 519, connected by means of tube 520 with the inspiration bag 511.

In FIG. 11 is shown a diagram exemplifying the proportions of the flow of breathing gases, air and Heliox mixture in an automatic breathing apparatus according to the preferred embodiment of the invention illustrated in FIG. 10.

The various working conditions are the following:

a) at surface level the regulator A works, the spring of which is calibrated to provide, at Pa=1, a breathing air flow equivalent to approximately 27,5 liters/minute, while the regulator B supplies a limited flow of Heliox mixture equal to approximately 2,5 liters/minute. With the air cylinder 500 full, there is no delivery of gas from the regulator C, as the air pressure in the cylinder 500 (through the tube 503A) counterbalances the thrust of the spring 303 in the regulator C, closing the relative plug.

b) When immersion commences, the environmental pressure Pa increases, and consequently in regulator A the environmental pressure passing through bore 111 thrusts against the spring 101 and reduces, as the Pa progressively increases, its calibration thrust, therefore progressively reducing the pressure in the chamber 112 and giving a consequent progressive reduction of the flow leaving nozzle 113.

In the type B regulator, on the contrary, the environmental pressure Pa acts, through the bore 209, on the diaphragm 201 to create the calibration thrust, which increases as the depth increases (environmental pressure Pa), creating an increase in pressure in the chamber 211 and a consequent increase in the flow leaving nozzle 212.

The active surfaces of the diaphragms of regulators A and B are proportioned in such a way that the flow of gas leaving the nozzles of the respective regulators increases and decreases in an inverse manner one with respect to the other.

Therefore, in type A the breathing gas (air) decreases its flow as the depth increases (environmental pressure Pa) and increases again as the Pa decreases.

Whereas in type B the flow of breathing gas (Heliox) increases as the Pa increases (environmental pressure) and decreases again as said pressure decreases.

As can be seen from the diagram in FIG. 11, at the maximum depth provided (approximately 150 meters) there will be a flow of air equivalent to approximately 5,5 liters/minute and a flow of Heliox mixture equivalent to approximately 37,5 liters/minute. (The overall flow of oxygen decreases as the depth increases, as shown on the respective identification line on the diagram in FIG. 11).

c) If the air pressure in the cylinder 500 descends to such a level that the regulator A does not work correctly, as its field of regulation is intrinsically fairly limited, the regulator C starts to function. Its flow is modulated both by the environmental pressure (Pa) (bore 316) and by the pressure within the cylinder 500 (tube 503A), which both limit the intervention of the spring 303 to the calibrated environmental pressure. In this way the combined action of regulators A and C guarantees a correct flow of air, in spite of the wide range of values of the environmental pressure Pa, which could not be managed using a single flow regulator of a mechanical type.

d) The transfer regulator D starts to work automatically when the pressure of the Heliox mixture in the cylinder 501 drops below a level which is predetermined at the moment of calibration of the spring 403, so that the reducer or I stage of the emergency open circuit supply connected to the Heliox cylinder 501 can continue to work correctly until cylinders 500 and 501 are almost completely empty, thus increasing emergency autonomy.

The transfer regulator D is basically an auxiliary device to increase autonomy should it be necessary to breath on an open circuit.

On the basis of the preceding description and with reference to FIGS. 6, 7, 8, 9 and 10, it would be immediately obvious to a person skilled in the field to create structures as exemplified in FIGS. 2, 3 and 5.

Figure 12:
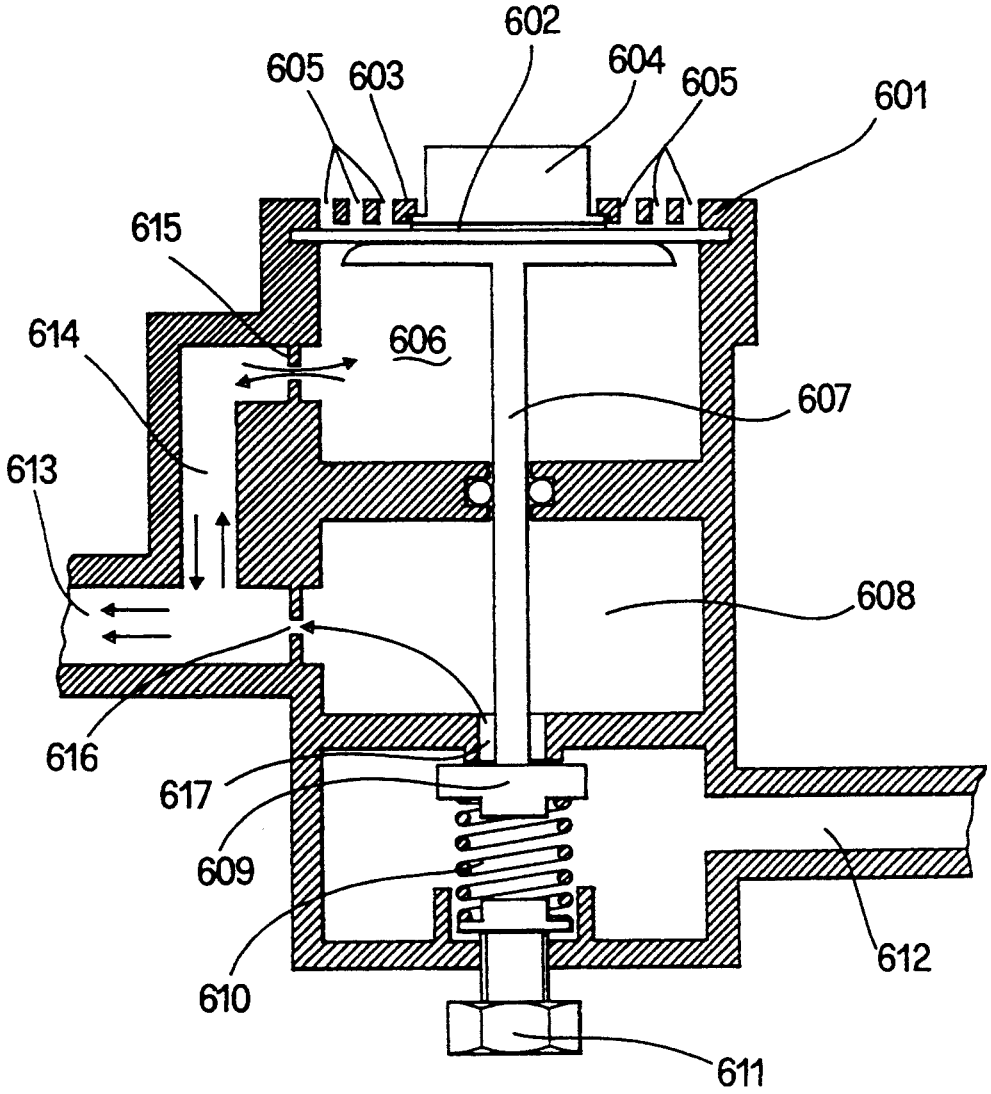
FIG. 12 shows an automatic/manual by-pass device useful as an add-on feature for the apparatus according to the invention.

With reference now to FIG. 12, an automatic/manual by-pass device will now be described which is particularly suited for use in conjunction with the embodiments of FIGS. 2 and 3 described above.

The by-pass devices 33, 33' that appear in FIGS. 1 and 2, are merely indicated as a functional block, as they are devices known to an expert in this field. These devices (33, 33') are manually commanded and they are actuated manually by the diver while underwater, according to need, serving to compensate the collapse of the bags due to increased environmental pressure during descent, which is due to the fact that the compression of the gases contained in said bags (causing a consequent reduction of their volume) takes place more rapidly than compensation of the flow into the bags themselves. This causes breathing problems for the diver, as the volume required to fill the bags is no longer present.

It is therefore necessary to increase the flow of gas into the bags, which up to the present has been done manually.

The object of the device illustrated in FIG. 12 is that of providing an automatic by-pass provided with manual actuation when necessary.

The automatic/manual by-pass device indicated above serves to compensate the collapse of the bags due to increased environmental pressure (Pa) during descent, in which case the compression of the gas, and therefore the reduction in volume of the bags, is more rapid than compensation of the flow into the bags themselves and therefore balancing of the volume.

According to the invention, this by-pass has both functions, that is to say it is automatic, but can also be used manually for washing-out of the bags.

It also compensates for the rapid variation in mixture which would be found in the bags in relation to environmental pressure in the case of too rapid a descent: in fact, in the breathing apparatus described previously there is an automatic mixing of the gases so as to obtain an ideal breathing mixture at any depth within the range in which the apparatus is intended to be used.

There is, however, the problem that, when starting from surface level and reaching a depth x in a period of time y, there is an excess of gas prevalent on the surface, this being because the descent period, and therefore that for increase of the pressure, is less than the time required for adjustment of the mixture obtained from the normal flows from reducers of types "A" and "B". For example: in the "air-oxygen" breathing apparatus, the object is that of obtaining a breathing gas which is hyperoxygenated with respect to the air, although always within scientifically acceptable limits in relation to the Pp $O_2$ (partial oxygen pressure).

It can therefore be seen that, at a certain speed of descent, the oxygen present in the bags when at surface level creates and excess of oxygen in the (ideal) mixture for a certain depth, thus exceeding the acceptable Pp for $O_2$.

In this case, the automatic intervention of the by-pass, which is connected to the "B" type reducer, that is to say the air reducer, introduces a flow of air greater than normal, which, having in its natural structure a lower percentage of $O_2$ than that in the mixture produced by the apparatus, lowers the excess of oxygen, bringing it back to ideal $Pp_2$ values within an acceptable amount of time.

The same thing can be said for the other embodiments of apparatuses described previously.

For this reason the automatic intervention of the by-pass, which is connected upstream to the adjustment chamber of the primary reducer (B), but which is provided on its outlet side with a nozzle having a bore larger than that of the nozzle on the outlet side of the continuous service reducer (B), increases the flow rate in such a way as to create a semi-washout of the bags, bringing the adjustment times of the mixture back down to extremely low, scientifically acceptable values.

The automatic-manual by-pass device is substantially comprised, as can be seen from FIG. 12, of a body 601, a membrane 602, a disk 603, a manual button 604, bores 605 which allow entry of the environmental pressure, a balancing chamber 606, a connection element 607, a transfer chamber 608, a plug 609, an adjustable contrast spring 610, a calibrating bolt 611, an inlet tube 612, an outlet tube 613, a tube 614 giving access to the balancing chamber, a transfer nozzle 615, an adjustment nozzle 616, a passing bore 617.

It should be noted that the outlet tube 613 corresponds to the tubes 35, 35' of FIGS. 2 and 3, and similarly the inlet tube 612 corresponds to the tubes 34, 34' of said figures.

The device functions as follows: the gas at a regulated pressure, which comes through the tube 612 from the adjustment chambers of the reducers of types (A) and (B), hereinbefore described, passes through the bore 617 into the transfer chamber 608 and from there, through the nozzle 616, into the tube 613 and from this directly into the inspiration bag of the breathing apparatus.

The tube 613 is connected, by means of the tube 614 and the nozzle 615, to the balancing chamber 616.

Upon rapid increase of the environmental pressure (Pa), which acts by means of bores 605, the membrane 602 flexes towards the inside of the chamber 606. Consequently, the disk 603 also undergoes the same movement, so that, by means of the connection element 607, said movement causes the plug 609 to open and allows the gas coming from the tube 612 to transfer into the chamber (A), from where it finally reaches, through the adjustment nozzle 616 and the tube 613, the inspiration bag.

By means of the tube 614 and the nozzle 615, the gas at environmental pressure (Pa), situated within the tube 617, reaches the balancing chamber 606. This takes a longer time than the speed at which the environmental pressure increases, and it is this fact that creates a momentary loss of balance between environmental pressure (Pa) and the pressure existing in the chamber 606, causing the movement described above which opens the plug 609.

When, by means of the tube 614 and the nozzle 615, the pressure in the chamber 606 is restored to its balance with the environmental pressure, the contrast spring 610 will press the plug 609 so as to close the passage 617.

Therefore the by-pass acts automatically only in the case of a rapid increase in the environmental pressure, in the case of a diver descending at a speed such that the normal flow of the primary regulators (A) and (B) is not sufficient to compensate the reduction in volume of the bags due to the compression of the gas.

The by-pass will work automatically during the whole of the rapid descent and for a few seconds after completion of said descent, until the balance of pressure between the chamber 606 and the environment (Pa) has been restored.

The button 604 serves for manual intervention in the case that it should be considered necessary to wash out the bags, even though no rapid change of level capable of causing a rapid increase in environmental pressure has taken place.

Closing of the head of the body 601, where the bores 605 and the button 604 are to be found, serves to prevent any explosive breaking of the membrane 602 in the case of too rapid an ascent. In fact, in such a case, the balancing chamber 606 would be in overpressure with respect to the environmental pressure (Pa).

I claim:

1. An automatic breathing apparatus for underwater use by a diver over a series of depths, said apparatus comprising:

a plurality of different pressurized breathing gas sources, regulator group means for supplying a final mixture of breathing gas having a percentage of breathing gas from each of said plurality of different pressurized breathing gas sources to form a volume of said final mixture of breathing gas in response to ambient pressure at every depth of a series of depths wherein said volume of said final mixture is increased with ambient pressure, each of said plurality of different pressurized breathing gas sources being upstream in pressurized communication with said regulator group means, a mouthpiece downstream of said regulator group means in pressurized communication with said regulator group to allow a diver to inhale a final mixture of breathing gas from said regulator group means and receive exhaled breathing gas from the diver, wherein said regulator group comprises first regulator means located in pressurized communication with a first pressurized breathing gas source of said plurality of different breathing gas sources for decreasing a flow of gas to said final mixture of breathing gas from said first pressurized breathing gas source as the depth of said series of depths increases, second regulator means located in pressurized communication with a second pressurized breathing gas source of said plurality of different breathing gas sources for increasing a flow of gas to said final mixture of breathing gas from said second pressurized breathing gas source as the depth of said series of depths increases, wherein said first pressurized breathing gas source contains compressed oxygen, and said second pressurized breathing source contains compressed air.

2. The automatic breathing apparatus according to claim 1 wherein said first regulator means and said second regulator means are upstream in pressurized communication with a plenum to receive said final mixture of breathing gas and said plenum is downstream in pressurized communication with said mouthpiece, a discharge bag having an overpressure discharge valve and a soda lime filter located respectively in series upstream in pressurized communication with said mouthpiece, said soda lime filter being downstream in pressurized communication with said plenum, wherein, an automatic pass-by means is provided in pressurized communication between said regulator group and said plenum for increasing a flow of gas to automatically flush said plenum and said discharge bag when a diver descends over a selected rate of speed exceeding that of a normal descent.

* * * * *